US010513011B2

(12) United States Patent
Legerbaum et al.

(10) Patent No.: US 10,513,011 B2
(45) Date of Patent: Dec. 24, 2019

(54) LAYERED NONCONTACT SUPPORT PLATFORM

(71) Applicant: Core Flow Ltd., Daliyat el-Karmel (IL)

(72) Inventors: Yaacov Legerbaum, Haifa (IL); Ronen Lautman, Haifa (IL); Leonid Nosovsky, Yokneam (IL); Boaz Nishri, Kibbutz Maagan Michael (IL)

(73) Assignee: Core Flow Ltd., Daliyat el-Karmel (IL)

( * ) Notice: Subject to any disclaimer, the term of this patent is extended or adjusted under 35 U.S.C. 154(b) by 223 days.

(21) Appl. No.: 15/807,560

(22) Filed: Nov. 8, 2017

(65) Prior Publication Data

US 2019/0134785 A1 May 9, 2019

(51) Int. Cl.
*B25B 11/00* (2006.01)

(52) U.S. Cl.
CPC ..... *B25B 11/005* (2013.01)

(58) Field of Classification Search
CPC ..... B25B 11/00; B25B 11/005; B25B 11/02
See application file for complete search history.

(56) References Cited

U.S. PATENT DOCUMENTS 5,618,759 A * 4/1997 Boysel ..... B25B 11/005 438/464
6,672,576 B1 * 1/2004 Walker ..... B23Q 16/001 269/21
6,764,258 B1 * 7/2004 Akre ..... B23Q 1/5468 269/21
7,607,647 B2 * 10/2009 Zhao ..... B25B 11/005 269/20
9,205,558 B1 12/2015 Zevenbergen et al.
2006/0054774 A1 3/2006 Yassour et al.
2018/0311796 A1 * 11/2018 Ishino ..... H01L 21/6875
2019/0134785 A1 * 5/2019 Legerbaum ..... B25B 11/005

FOREIGN PATENT DOCUMENTS

KR 20110097615 8/2011
KR 20160078280 7/2016

OTHER PUBLICATIONS

International Search Report and Written Opinion for PCT International Application No. PCT/IL2018/051110 dated Dec. 17, 2018.

* cited by examiner

*Primary Examiner* — Lee D Wilson
(74) *Attorney, Agent, or Firm* — Pearl Cohen Zedek Latzer Baratz LLP

(57) ABSTRACT

A noncontact support system includes a table with a port layer having a pattern of interspersed pressure ports and vacuum ports. A pressure conduit layer includes a grid pattern of pressure conduits, connectable to a pressure source, each of the pressure ports being located on an axis passing through an intersection of at least two of the pressure conduits and substantially orthogonal to the grid pattern of pressure conduits. A vacuum conduit layer includes a grid pattern of vacuum conduits, connectable to a suction source, each of the vacuum ports being located on an axis passing through an intersection of at least two of the vacuum conduits and substantially orthogonal to the grid pattern of vacuum conduits. The grid pattern of vacuum conduits is laterally offset from the grid pattern of pressure conduits such that each intersection of pressure conduits is laterally offset from all intersections of the vacuum conduits.

20 Claims, 8 Drawing Sheets

LAYERED NONCONTACT SUPPORT PLATFORM

FIELD OF THE INVENTION

The present invention relates to support surfaces. More particularly, the present invention relates to a noncontact support platform with pressure and vacuum conduits arranged in multiple layers.

BACKGROUND OF THE INVENTION

Many industries have a need to process thin and flexible workpieces. For example, flat panel display industry requires processing of large pieces of thin glass sheets, e.g., having lateral dimensions (length and width) of tens of centimeters to meters, and thicknesses of less than one millimeter. In many cases, any unnecessary physical contact of the workpiece with a surface or object, e.g., contact that is not required for processing of the workpiece, may risk scratching or otherwise damaging or marring the workpiece.

A common solution is to support the workpieces on a noncontact support platform. A noncontact support platform typically includes a tabletop that is configured to form an air cushion above the tabletop. For example, the tabletop may include a distribution of pressure ports out of which air is forced above the tabletop. In many cases, vacuum ports to which suction is applied are interspersed among the pressure ports.

When a workpiece is rigid, local bending of the workpiece may be negligible. In this case, if the air cushion that is formed by the noncontact support platform is sufficiently thick, the workpiece may be supported at a uniform distance from the tabletop and there may be no risk of contact between the workpiece and the tabletop.

However, if the workpiece is flexible, and if the force exerted by the air cushion that is formed is not uniform below the workpiece, the workpiece that is supported by the air cushion may bend or dimple. For example, in some cases, the dimpling may form an "egg crate" pattern on the workpiece. In this case, part of the workpiece may bend or sag toward the tabletop, risking contact between the workpiece and the tabletop. In addition, non-uniform support of the workpiece may adversely affect a manufacturing or inspection process that is being performed on the workpiece.

SUMMARY OF THE INVENTION

There is thus provided, in accordance with an embodiment of the present invention, a noncontact support system having a table including: a port layer that includes a pattern of interspersed pressure ports and vacuum ports; a pressure conduit layer that includes a grid pattern of pressure conduits, connectable to a pressure source, each of the pressure ports being located at a location on an axis passing through an intersection of at least two of the pressure conduits and substantially orthogonal to the grid pattern of pressure conduits at that location; and a vacuum conduit layer that includes a grid pattern of vacuum conduits, connectable to a suction source, each of the vacuum ports being located at a location on an axis passing through an intersection of at least two of the vacuum conduits and substantially orthogonal to the grid pattern of vacuum conduits at that location, the grid pattern of vacuum conduits being laterally offset from the grid pattern of pressure conduits such that each intersection of pressure conduits is laterally offset from all intersections of the vacuum conduits.

Furthermore, in accordance with an embodiment of the present invention, the pressure conduit layer and the vacuum conduit layer each includes a service hole that is configured to enable insertion of a fastener or sensor when a service hole of the pressure conduit layer is aligned with the service hole of the vacuum conduit layer, each of the service holes being laterally displaced from all of the pressure and vacuum conduits.

Furthermore, in accordance with an embodiment of the present invention, the service hole is located such that a lateral distance between the service hole and the nearest conduit is greater than a minimum distance.

Furthermore, in accordance with an embodiment of the present invention, the grid pattern is a square pattern, and wherein the service hole is located laterally midway between a pressure port and the nearest vacuum port.

Furthermore, in accordance with an embodiment of the present invention, the grid pattern of each of the pressure conduit layer and the vacuum conduit layer is a square pattern with a segment of a pressure conduit and an orthogonal vacuum conduit removed in a square region bounded by two of the intersections between pressure conduits and two of the intersections between vacuum conduits.

Furthermore, in accordance with an embodiment of the present invention, the service hole is located in the square region.

Furthermore, in accordance with an embodiment of the present invention, the pressure conduit layer includes an opening to a pressure manifold or the vacuum conduit layer includes an opening to a vacuum manifold.

Furthermore, in accordance with an embodiment of the present invention, the noncontact support system includes at least one flow restrictor layer that includes a flow restrictor to restrict airflow between the pressure conduit layer and a pressure port of the port layer.

Furthermore, in accordance with an embodiment of the present invention, the noncontact support system includes at least one flow restrictor layer that includes a flow restrictor to restrict airflow between the vacuum conduit layer and a vacuum port on the port layer.

Furthermore, in accordance with an embodiment of the present invention, the noncontact support system includes an insert for insertion of a port of the port layer, the insert including a flow restrictor.

Furthermore, in accordance with an embodiment of the present invention, the flow restrictor includes a self-adaptive segmented orifice (SASO) flow restrictor.

Furthermore, in accordance with an embodiment of the present invention, the flow restrictor includes a linear arrangement of a plurality of bore segments separated by narrower restrictive segments.

Furthermore, in accordance with an embodiment of the present invention, the flow restrictor includes a restrictive tube having a constant diameter along its length.

Furthermore, in accordance with an embodiment of the present invention, the flow restrictor includes a restrictive tube that includes one or more constricted segments.

Furthermore, in accordance with an embodiment of the present invention, the flow restrictor includes a porous substance.

Furthermore, in accordance with an embodiment of the present invention, a corner at an intersection between conduits in the pressure conduit layer or the vacuum conduit layer is rounded.

There is further provided, in accordance with an embodiment of the present invention, a method for assembling a noncontact support system, the method including: assembling to a port layer that includes a pattern of interspersed pressure ports and vacuum ports a pressure conduit layer that includes a grid pattern of pressure conduits that are connectable to a pressure source, such that each of the pressure ports opens to an intersection of at least two of the pressure conduits; and assembling to the port layer and to the pressure conduit layer a vacuum conduit layer that includes a grid pattern of vacuum conduits that are connectable to a suction source such that each of the vacuum ports opens to an intersection of at least two of the vacuum conduits, the grid pattern of vacuum conduits being laterally offset from the grid pattern of pressure conduits such that each intersection of pressure conduits is laterally offset from all intersections of the vacuum conduits.

Furthermore, in accordance with an embodiment of the present invention, assembling the vacuum conduit layer to the pressure conduit layer includes aligning a service hole on the pressure layer with a service hole on the vacuum conduit layer, the service hole being laterally displaced from all of the pressure ports and all of the vacuum ports.

Furthermore, in accordance with an embodiment of the present invention, the method includes inserting a fastening structure through the service holes and into a hole or socket of the port layer that is aligned with the services holes on the pressure conduit layer and the vacuum conduit layer.

Furthermore, in accordance with an embodiment of the present invention, the method includes insertion of a flow restrictor layer between at least the pressure conduit layer and the port layer.

BRIEF DESCRIPTION OF THE DRAWINGS

In order for the present invention to be better understood and for its practical applications to be appreciated, the following figures are provided and referenced hereafter. It should be noted that the Figures are given as examples only and in no way limit the scope of the invention. Like components are denoted by like reference numerals.

DETAILED DESCRIPTION OF THE INVENTION

Figure 1A:
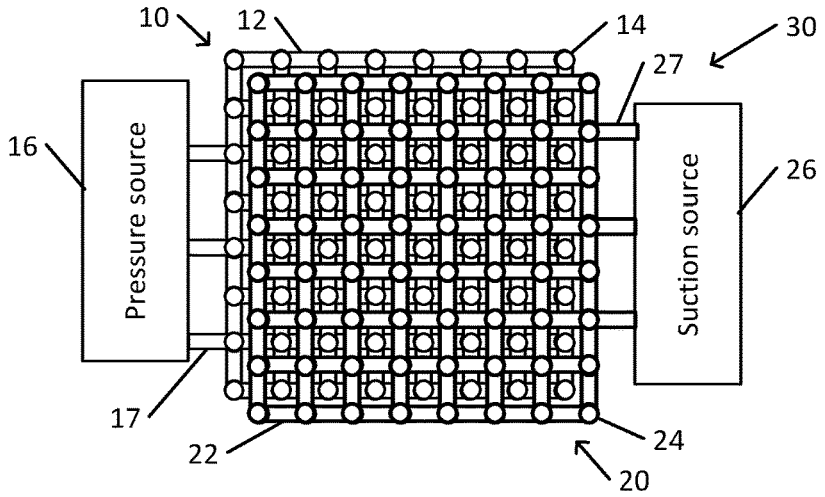
FIG. 1A schematically illustrates a layered arrangement of pressure conduits and vacuum conduits of a noncontact support platform, in accordance with an embodiment of the present invention.

In the following detailed description, numerous specific details are set forth in order to provide a thorough understanding of the invention. However, it will be understood by those of ordinary skill in the art that the invention may be practiced without these specific details. In other instances, well-known methods, procedures, components, modules, units and/or circuits have not been described in detail so as not to obscure the invention.

Although embodiments of the invention are not limited in this regard, discussions utilizing terms such as, for example, "processing," "computing," "calculating," "determining," "establishing", "analyzing", "checking", or the like, may refer to operation(s) and/or process(es) of a computer, a computing platform, a computing system, or other electronic computing device, that manipulates and/or transforms data represented as physical (e.g., electronic) quantities within the computer's registers and/or memories into other data similarly represented as physical quantities within the computer's registers and/or memories or other information non-transitory storage medium (e.g., a memory) that may store instructions to perform operations and/or processes. Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. Unless explicitly stated, the method embodiments described herein are not constrained to a particular order or sequence. Additionally, some of the described method embodiments or elements thereof can occur or be performed simultaneously, at the same point in time, or concurrently. Unless otherwise indicated, the conjunction "or" as used herein is to be understood as inclusive (any or all of the stated options).

In accordance with an embodiment of the present invention, a noncontact support platform system for generating an air cushion for supporting a thin, flat, and flexible workpiece includes an array of interspersed pressure ports and vacuum ports. The noncontact support platform is constructed from a plurality of layers. Although a noncontact support platform generates a cushion of air, the cushion may include another gas or liquid. Therefore, when reference is made herein to air, e.g., when referring to an air cushion, air pressure, airflow, or in other contexts, the term "air" should be understood as including any other gaseous or liquid fluid.

For example, the uppermost layer (the layer closest to the air cushion that is formed by the noncontact support platform) may be a tabletop or port layer that includes a plurality of dispersed openings that are configured to function as interspersed pressure and vacuum ports. In addition, the port layer may include an arrangement of fastener sockets that enable insertion of structure for fastening the layers of the noncontact support platform to one another. Each fastener socket may enable insertion of a screw, bolt, post, nut, or other fastening structure that may be inserted into the fastener socket and tightened in order to fasten the layers of the noncontact support platform to one another and to laterally align the layers with one another. For example, the various layers of the noncontact support platform may include corresponding service holes that are configured to be aligned with one another when the layers are assembled into the noncontact support platform. Each service hole may be located such that no service hole in any layer coincides completely or partially with a conduit of that layer. In some cases, the port layer may include service bores that traverse the thickness of the port layer (e.g., instead of a fastener socket). For example, such a service bore may enable an inserted sensor to view or measure a property or position of a supported workpiece.

A pressure conduit layer of the noncontact support platform may include the pressure conduits that connect each of the pressure ports to a pressure source (e.g., a blower or other device that creates an outflow of air). The pressure conduits may be arranged in the form of a grid pattern of interconnected conduits that is confined to the layer. For example, the pressure conduits may be formed by machining a grid pattern of pressure channels into a flat slab or sheet of metal, plastic, or another suitable material. When the pressure channels are assembled into the noncontact support platform, another layer that abuts the pressure conduit layer may close and seal the open side of each pressure channel, thus forming elongated pressure conduits for conducting airflow in a single direction. Pressure ports may be located above nodes of the grid pattern where channels oriented in different directions (e.g., orthogonal directions) meet one another and intersect. Alternatively, or in addition, pressure ports may be located above another part of a pressure conduit. A vertical channel in any intervening layers between the pressure conduit layer and the port layer may enable passage of air between each of the nodes (or other parts of a pressure conduit) and its corresponding pressure port.

Similarly, a vacuum conduit layer of the noncontact support platform may include the vacuum conduits that connect each of the vacuum ports to a suction source (e.g., an intake of a blower, a vacuum or suction pump, or another device that creates suction or an inflow of air). The vacuum conduits may be arranged in the form of a grid pattern of interconnected conduits that is confined to the vacuum conduit layer. For example, the conduits may be formed by machining a grid pattern of vacuum channels into a flat slab or sheet of metal, plastic, or another suitable material. When the vacuum channels are assembled into the noncontact support platform, another layer that abuts the vacuum conduit layer may close and seal the open side of each of the vacuum channels, thus forming elongated vacuum conduits for conducting airflow in a single direction. Vacuum ports may be located above nodes of the grid pattern where vacuum conduits that are oriented in different directions (e.g., orthogonal directions) meet one another and intersect. Alternatively, or in addition, vacuum ports may be located above another part of a vacuum conduit. A vertical channel in any intervening layers between the vacuum conduit layer and the port layer may enable passage of air between each of the nodes (or other parts of a vacuum conduit) and its corresponding vacuum port.

When assembled into the noncontact support platform, the pressure conduit layer and the vacuum conduit layer may be aligned such that the grid pattern of pressure conduits is laterally offset relative to the grid pattern of vacuum conduits. The offset may ensure that each node of the grid pattern of pressure conduits is laterally offset from all nodes of the grid pattern of vacuum conduits, and vice versa. In one example, the grid pattern of pressure conduits and the grid pattern of vacuum conduits may be square grid patterns. In each square grid pattern, the sides of each square are formed by the conduits, and the corners of each square represent the nodes where orthogonal conduits intersect. In this example, the grid patterns of the pressure conduits and the vacuum conduits may be laterally offset from one another such that each node of the pressure conduit grid pattern is located above or below the center of a square of the vacuum conduit grid pattern, and vice versa.

A service hole of the port layer may be positioned such the service hole, and the bores that continue the service hole in other, lower layers, do not cross (e.g., do not open into) any pressure conduits or vacuum conduits. In the example of the square grid patterns described above, a service hole may be placed halfway along a diagonal that connects a pressure port with the laterally nearest vacuum port. With this arrangement, the perpendicular lateral distance between the service hole and each of the four laterally nearest conduits (e.g., two pressure conduits and two vacuum conduits) is the same.

The various layers may be assembled to form a noncontact support platform table. In some cases, a pressure port may connect to its pressure source, and, optionally, a vacuum port may connect to its suction source, via a flow restrictor or restricting nozzle. The flow restrictor may cause the airflow through the pressure and vacuum ports to generate a fluidic spring effect. When the air cushion behaves as a fluidic spring, a workpiece may be supported at a precise distance from the tabletop. In the presence of a fluidic spring effect, the tabletop may be located above the workpiece. As used herein, references to up, top, upward, and above refer to the direction from the tabletop to the supported workpiece, whether the workpiece is supported from above or below (e.g., as view by an upright observer). Similarly, references to down, bottom, downward, and below refer to the direction toward the tabletop and away from the supported workpiece.

Given an arrangement of pressure ports and vacuum ports, e.g., the example of the square grid arrangement described above, uniformity of the air cushion that is created by the noncontact support platform may be increased by decreasing the distance between each pair of adjacent or nearest ports. For example, a local deformation $d\varepsilon$ of a workpiece of thickness t may be described by the relation $d\varepsilon \sim L^4/t^3$, where L is the lateral distance between a vacuum port and the nearest pressure port on the tabletop. Thus, in order for uniformity of the air cushion to be maintained when the thickness of the workpiece is halved, the distance L must be reduced to about 60% of its previous value. In this case, the density of openings, and thus the output of the pressure and suction sources, may be increased by a factor of close to three in order to maintain a maximum deformation of the thinner workpiece.

In practice, a service hole and the fastening structure (e.g., a screw or bolt) that is to be inserted into the service hole will have a finite diameter. Furthermore, a lateral distance between the service hole and the nearest conduits must be sufficient such that insertion and fastening of the fastening structure (e.g., applying torque to a screw or bolt that is inserted into a threaded bore) does not damage or destroy the structure between the bore and the conduits (e.g., at least a few millimeters) and to achieve adequate sealing between the conduits and the service holes. Thus, in some cases, in order to enable a sufficient reduction of the distance between adjacent ports so as to achieve a desired level of uniformity of the air cushion and sealing, the arrangement of conduits may require modification.

For example, the offset square grid arrangement described above includes lateral locations, or crossing points, where a vacuum conduit in one crosses a pressure conduit in another layer. If the crossing conduits are eliminated from the vacuum and pressure layers near the crossing point, a service hole may be placed at the original location of the crossing point. The cross-sectional area of each vacuum conduit and pressure conduit may be sufficient such that elimination of the conduits near the crossing points does not adversely affect the suction or pressure through the neighboring ports. In this manner, for a given minimal distance between the service hole and the nearest conduits and for the same widths of the conduits, a distance between a pressure port and its nearest neighboring vacuum port may be halved (while the spatial density of the ports is quadrupled). In this manner, the uniformity of the air cushion may be increased without reduction in the number of service holes or otherwise adversely affecting the quality of the connection between each vacuum port or pressure port and its respective suction or pressure source.

FIG. 1A schematically illustrates a layered arrangement of pressure conduits and vacuum conduits of a noncontact support platform, in accordance with an embodiment of the present invention.

Layered conduit structure 30 of a noncontact support platform includes pressure conduit layer 10, connected to pressure source 16 (e.g., a blower, pump, or connection to source of pressurized air or of other pressurized gaseous or liquid fluid) via one or more pressure connections 17, and vacuum conduit layer 20 connected to suction source 26 (e.g., a pump, blower intake, or other source of suction) via one or more suction connections 27. Pressure conduit layer 10 and vacuum conduit layer 20 are arranged such that the locations of pressure ports 14 of pressure conduit layer 10 are laterally offset from the locations of vacuum ports 24 of vacuum conduit layer 20.

In the context of FIGS. 1A-4B, reference is made for convenience to pressure ports 14 of pressure conduit layer 10 and to vacuum ports 24 of vacuum conduit layer 20. However, pressure ports 14 and vacuum ports 24 should be understood as referring to lateral locations of ports on a tabletop port layer above pressure conduit layer 10 and vacuum conduit layer 20, and to vertical channels that connect these locations to the actual ports in the tabletop port layer.

In the example shown, pressure conduits 12 of pressure conduit layer 10 and vacuum conduits 22 of vacuum conduit layer 20 are each arranged in the form of uniform square grid pattern. Other arrangements of conduits are possible, e.g., a rectangular, parallelogram, or other arrangement of straight or curved conduits.

In the example shown, each vacuum port 24 of vacuum conduit layer 20 is at the center of each square of pressure conduits 12 of pressure conduit layer 10. Thus, each vacuum port 24 is positioned equidistant from the four nearest neighboring pressure ports 14 of pressure conduit layer 10. Similarly, each pressure port 14 of pressure conduit layer 10 is at the center of each square of vacuum conduits 22 of vacuum conduit layer 20. Thus, each pressure port 14 is positioned equidistant from the four nearest neighboring vacuum ports 24 of vacuum conduit layer 20. Other arrangements of laterally displaced vacuum ports 24 and pressure ports 14 are possible.

Figure 1B:
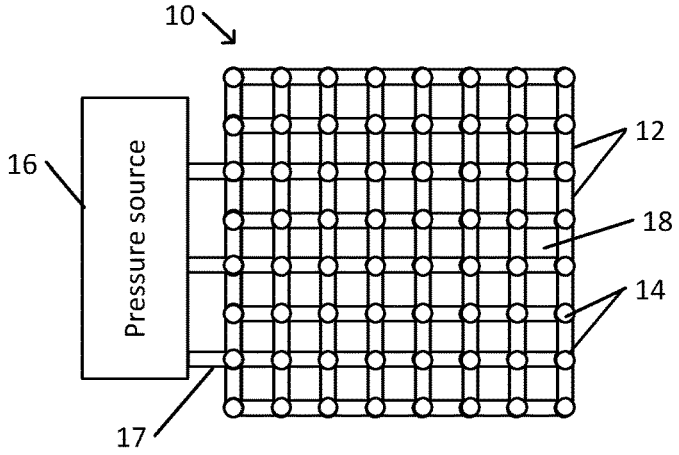
FIG. 1B schematically illustrates a pressure conduit layer of the layered arrangement of the noncontact support platform shown in FIG. 1A.

FIG. 1B schematically illustrates a pressure conduit layer of the layered arrangement of the noncontact support platform shown in FIG. 1A.

In the example shown, each pressure port 14 of pressure conduit layer 10 is located at a node of the grid of pressure conduit layer 10 at an intersection between two or more pressure conduits 12 having different orientations (e.g., orthogonal as in the example shown or at another oblique angle). Alternatively, or in addition, pressure ports may be located elsewhere on a pressure conduit 12. Pressure conduits 12 surround pressure layer spaces 18, where no pressure conduits 12 or pressure ports 14 are present.

Figure 1C:
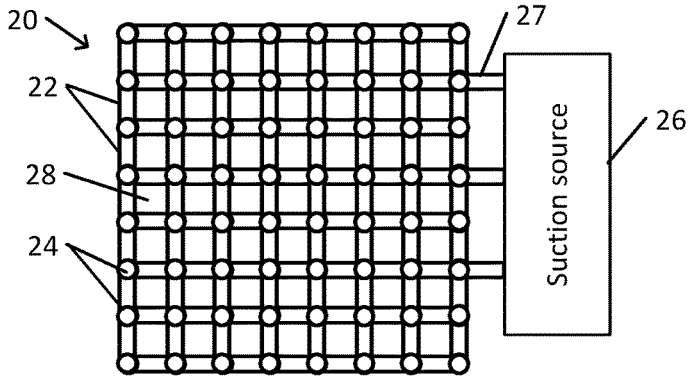
FIG. 1C schematically illustrates a vacuum conduit layer of the layered arrangement of the noncontact support platform shown in FIG. 1A.

FIG. 1C schematically illustrates a vacuum conduit layer of the layered arrangement of the noncontact support platform shown in FIG. 1A.

In the example shown, each vacuum port 24 of vacuum conduit layer 20 is located at a node of the grid pattern of vacuum conduit layer 20 at an intersection between two or more vacuum conduits 22 having different orientations (e.g., orthogonal as in the example shown or at another oblique angle). Alternatively, or in addition, vacuum ports may be located elsewhere on a vacuum conduit 22. Vacuum conduits 22 surround vacuum layer spaces 28, where no vacuum conduits 22 or vacuum ports 24 are present.

Pressure conduit layer 10 and vacuum conduit layer 20 may be assembled to form layered conduit structure 30. In the example shown, pressure conduit layer 10 and vacuum conduit layer 20 are laterally offset such that each pressure port 14 is located within a vacuum layer space 28 of vacuum conduit layer 20 and such that each vacuum port 24 is located within a pressure layer space 18 of pressure conduit layer 10. Other arrangements are possible (e.g., when pressure conduit layer 10 is not identical in layout to vacuum conduit layer 20).

In a pressure conduit layer 10 or vacuum conduit layer 20, pressure conduits 12 and vacuum conduits 22 may be formed by channels that are formed in a solid material. Sufficient sealing of pressure conduits 12 and vacuum conduits 22 may depend on close contact between open sides of the channels of each layer and a surface of another layer. In order that such close contact is assured, pressure conduit layer 10 and vacuum conduit layer 20 may be configured to be fastened to one another at locations dispersed across layered conduit structure 30. For example, fastening structure may include screws, bolts, or other structure may extend the entire thickness or height of layered conduit structure 30 or of a table of a noncontact support platform. The fastening structure may be inserted into service holes that are arranged among pressure ports 14 and vacuum ports 24 in layered conduit structure 30.

Figure 2:
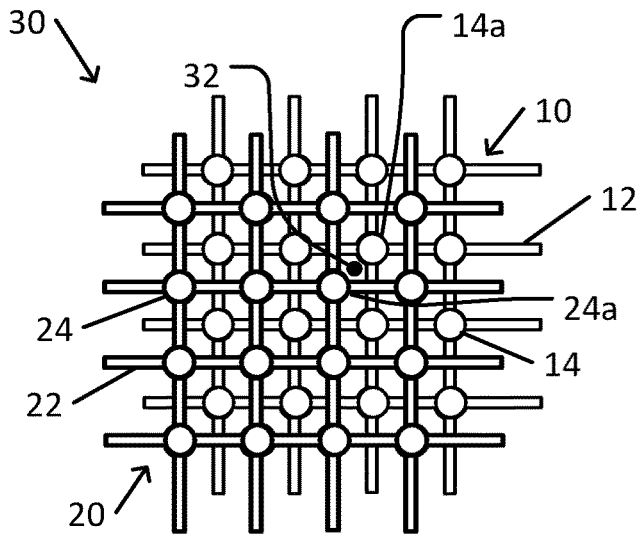
FIG. 2 schematically illustrates a service hole on the layered arrangement shown in FIG. 1A.

FIG. 2 schematically illustrates a service hole on the layered arrangement shown in FIG. 1A.

In the arrangement shown, service hole 32 is located approximately midway along the diagonal distance between nearest neighboring pressure port 14*a* and vacuum port 24*a*.

Service hole 32 is located such that service hole 32 does not open into any pressure port 14, vacuum port 24, pressure conduit 12, or vacuum conduit 22.

Service hole 32 may be positioned such that a thickness of material between service hole 32 and the nearest pressure conduit 12 or vacuum conduit 22 (as well as the nearest pressure port 14 or vacuum port 24) is sufficient to ensure that tightening a fastening structure in service hole 32 will not unduly stress or breach the intervening material.

Figure 3:
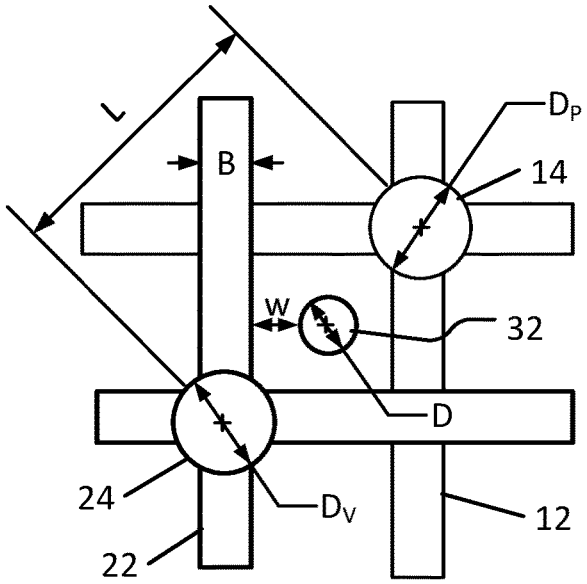
FIG. 3 schematically illustrates dimensions related to calculation of a distance between the service hole shown in FIG. 2 and a nearest conduit.

FIG. 3 schematically illustrates dimensions related to calculation of a distance between the service hole shown in FIG. 2 and nearest conduit.

In the example of a square grid pattern that is shown, service hole 32 is located midway between pressure port 14 and vacuum port 24 along a diagonal connecting pressure port 14 and vacuum port 24. In the example shown, L is the diagonal center-to-center distance between pressure port 14 and vacuum port 24. The diameter of pressure port 14 is $D_P$, the diameter of vacuum port 24 is $D_V$, and the diameter of service hole 32 is D. The widths of pressure conduits 12 and vacuum conduits 22, at least in the vicinity of service hole 32, are all B. The shortest perpendicular distance between an edge of service hole 32 and the nearest pressure conduit 12 or vacuum conduit 22 (assumed to be equal) is w, in this case given by:

$$w = \frac{L}{\sqrt{8}} - \frac{D+B}{2}.$$

For example, if B=2 mm and D=4 mm, the distance L must be at least about 8.5 mm in order to avoid creating an opening between service hole 32 and one or both of the nearest pressure conduit 12 or vacuum conduit 22 (w>0). In some cases, a minimum distance w may be required, e.g., due to mechanical requirements. For example, when the minimum value of w is about 2 mm, the distance L must be greater than about 14 mm.

Since, as described above, local deformation of a thin workpiece is proportional to $L^4$, placement of service hole 32 between conduits of a square grid arrangement may limit the thinness of a workpiece that can be supported without excessive deformation.

Placement of a service hole 32 at a crossing between a pressure conduit 12 and a nonparallel vacuum conduit 22, while eliminating the conduits at the crossing, may enable decreasing the distance L between neighboring ports without adversely affecting performance of a layered conduit structure.

Figure 4A:
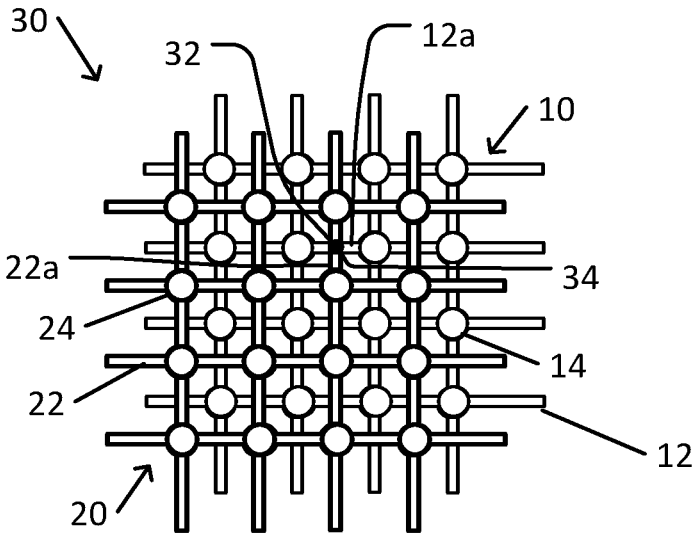
FIG. 4A schematically illustrates a location of a service hole at a crossing between a pressure conduit and a vacuum conduit of the layered arrangement shown in FIG. 1A.

FIG. 4A schematically illustrates a location of a service hole at a crossing between a pressure conduit and a vacuum conduit of the layered arrangement shown in FIG. 1A.

In the example shown, service hole 32 may be located at the lateral position of conduit crossing 34, where a pressure conduit 12 in pressure conduit layer 10 with one orientation crosses a vacuum conduit 22 in vacuum conduit layer 20 having another orientation (orthogonal, in the example of a square or rectangular grid pattern). It may be noted that no pressure port 14 or vacuum port 24 is located at conduit crossing 34.

In order to ensure that service hole 32 does not intercept pressure conduit 12 or vacuum conduit 22, pressure conduit 12 and vacuum conduit 22 may be removed from the location of conduit crossing 34. For example, pressure conduit 12 and vacuum conduit 22 may be removed when the cross-sectional areas of pressure conduit 12 and of vacuum conduit 22 are sufficient to ensure adequate pressure or suction that is applied to each pressure port 14 or vacuum port 24, respectively.

Figure 4B:
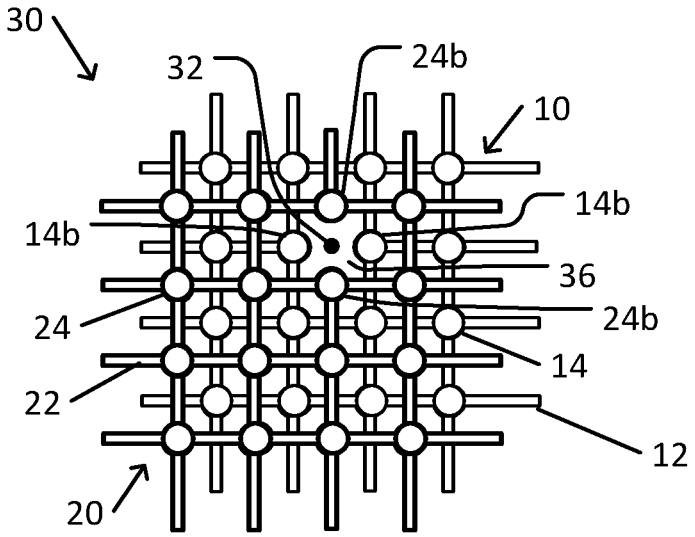
FIG. 4B schematically illustrates the service hole shown in FIG. 4A after elimination of the crossing conduits.

FIG. 4B schematically illustrates the service hole shown in FIG. 4A after elimination of the crossing conduits.

In the example shown, pressure conduit 12*a* is eliminated between pressure ports 14*b* (e.g., between the two intersections of pressure conduits 12 corresponding to pressure ports 14*b*). Thus, each pressure port 14*b* is located at a T-intersection of three segments of pressure conduits 12. Similarly, vacuum conduit 22*a* is eliminated between vacuum ports 24*b* (e.g., between the two intersections of vacuum conduits 22 corresponding to vacuum ports 24*b*). Thus, each vacuum port 24*b* is located at a T-intersection of three segments of vacuum conduits 22. The region from which pressure conduit 12*a* and vacuum conduit 22*a* have been eliminated forms service hole region 36 (which is square, in the example shown). Thus, a service hole 32 may be located within service hole region 36 without intersecting any pressure conduit 12, vacuum conduit 22, pressure port 14, or vacuum port 24.

When the width of each pressure conduit 12 is no smaller than the diameter of a pressure port 14 ($B \geq D_P$), and the width of each vacuum conduit 22 is no smaller than the diameter of a vacuum port 24 ($B \geq D_V$), then the shortest perpendicular distance w between service hole 32 and the nearest pressure conduit 12 or vacuum conduit 22 may be expressed as (in the case of a square grid pattern):

$$w = \frac{L}{\sqrt{2}} - \frac{D+B}{2}.$$

As before, L represents the diagonal center-to-center distance between a pressure port 14 and its nearest neighboring vacuum port 24 (in the example shown, between one of pressure ports 14*b* and one of vacuum ports 24*b*). When $D_P > B$, $D_V > B$, or both, width B in the formula for w may be replaced with the larger of $D_P$ or $D_V$.

In the above example, where B=2 mm and D=4 mm, the distance L must be at least about 4.2 mm in order to avoid creating an opening between service hole 32 and one or both of the nearest pressure conduit 12 or vacuum conduit 22 (w>0). Comparison with the configuration of FIG. 3 shows that the minimal value for L for the configuration of FIG. 4B is half the minimal value of L for the configuration of FIG. 3. Similarly, when the minimum value of w must be at least 2 mm, then the minimum value of distance L for the configuration of FIG. 4B must be greater than about 7 mm, again about half the minimum value for the configuration of FIG. 3.

Thus, the configuration of FIG. 4B may enable supporting a workpiece whose thickness is thinner than a workpiece that could be uniformly supported by another configuration (e.g., of FIG. 3). Since, as described above, local deformation of a thin workpiece is proportional to $L^4/t^3$, halving the distance between pressure port 14 and the nearest vacuum port 24 may enable supporting a workpiece with about 40% of the thickness of a workpiece that would be supported with similar deformation by the configuration of FIG. 3.

Removal of conduits from service hole region 36, affecting the uniformity and symmetry of the distribution of conduits, may also affect the pressure drops within each of pressure conduit layer 10 and vacuum conduit layer 20. For example, elimination of pressure conduit 12*a* that directly connects pressure ports 14*b* may cause the pressure outflow to flow through a more circuitous path, thus increasing the pressure drop. In order to compensate for this pressure drop, the cross sectional area (e.g., width or depth) of the remaining pressure conduits 12 may be increased, thus reducing the pressure drop to its original value.

In the example of FIGS. 1B (and 1A), a maximum of 24 pressure ports 14 (three rows of eight pressure ports 14) intervene between pressure connection 17 and the pressure port 14 most distant from a pressure connection 17. Similarly, in the example of FIGS. 1C (and 1A), a maximum of 24 vacuum ports 24 (three rows of eight vacuum ports 24) intervene between suction connection 27 and the vacuum port 24 most distant from a suction connection 27. If each pressure conduit 12 or vacuum conduit 22 has a depth of 3 mm and a width B of 2.25 mm, and if the distance L between each pressure port 14 and the nearest vacuum port 24 is 8 mm, and the airflow at each pressure port 14 or vacuum port 24 is 0.4 liter per minute, then the pressure drop may be about 3 mbar. Removal of pressure conduit 12*a* and vacuum conduit 22*a* from service hole region 36 when a service hole 32 is placed at 16 mm intervals may increase the pressure drop to 6 mbar. Increasing the width B of the remaining pressure conduits 12 and vacuum conduits 22 to 3.25 mm may restore the pressure drop to 3 mbar.

In the example discussed above, with distance L=8 mm, width B=2.25 mm, diameter D of each service hole 32 (and of a screw or bolt that is inserted and fastened within each service hole 32) is 4 mm. With the configuration of FIG. 2, having a uniform and symmetric distribution of pressure conduits 12 and vacuum conduits 22, such a configuration is not possible (w is negative, indicating leakage between service hole 32 and one or both of pressure conduit 12 and vacuum conduit 22). On the other hand, with the configuration of FIG. 4B, and including increasing width B to 3.25 mm, the distance w is about 2 mm, which is sufficient to provide good sealing between layers.

In another example, when L=14 mm, D=4 mm, w=2 mm, and with the configuration of FIG. 3, the maximum possible value of width B is less than 2 mm, resulting in a pressure drop of 3 mbar. On the other hand, with the configuration of FIG. 4B, width of B may be increased to as much as 6 mm, reducing the pressure drop to 1 mbar or less.

Further advantages may be achieved by enabling a relatively dense distribution of service holes 32. The configuration of FIG. 4B may enable sufficiently close placement of service holes 32 on a table top of a noncontact support system so as to enable formation of a flat surface. For example, in some cases, e.g., for production of flat panel displays, the table top may be required to be flat within 10 μm over an area of 3 m×1 m. This may be achieved by screwing or bolting a relatively thin plate (e.g., having a thickness of 10 mm, and a natural flatness of 100 μm) to a much thicker flat base using a large number of screws or bolts. In addition, one or more service holes 32 may be adapted to enable placement of a measuring of monitoring sensor within those service holes 32.

Figure 5A:
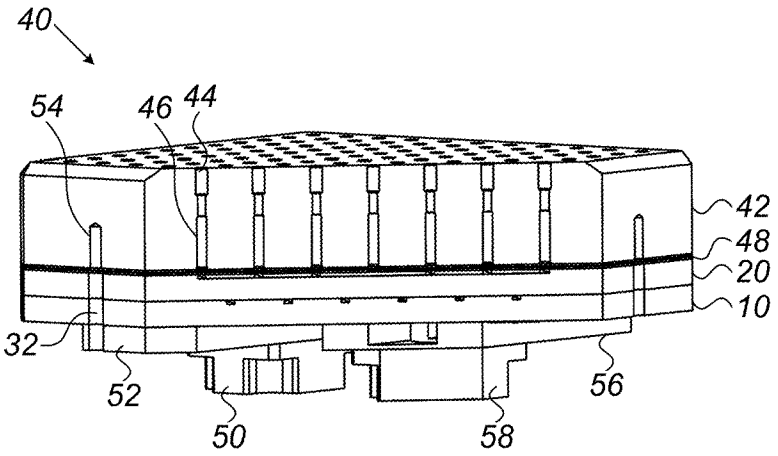
FIG. 5A schematically illustrates a noncontact support platform table that incorporates the layered arrangement shown in FIG. 1A.
Figure 5B:
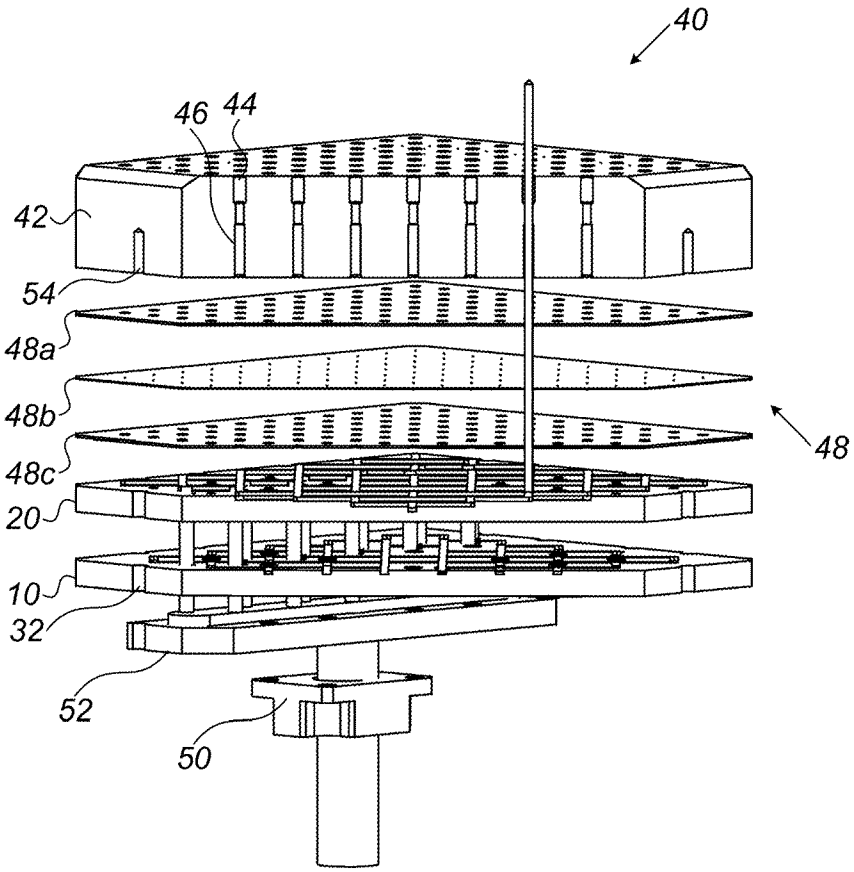
FIG. 5B schematically illustrates layers of the noncontact support platform table shown in FIG. 5A.

FIG. 5A schematically illustrates a noncontact support platform table that incorporates the layered arrangement shown in FIG. 1A. FIG. 5B schematically illustrates layers of the noncontact support platform table shown in FIG. 5A.

Noncontact support platform table 40 includes tabletop port layer 42. For example, tabletop port layer 42 may be precisely machined from a rigid block of metal with a plurality of tabletop ports 44. Each tabletop port 44 may open via a port channel 46 that traverses the entire thickness of tabletop port layer 42 to a pressure port 14 (actually a lateral location of the pressure port, visible in FIG. 1B) on pressure conduit layer 10 or to a vacuum port 24 (actually a lateral location of the vacuum port, visible in FIG. 1C) on vacuum conduit layer 20. In the example shown, an underside of tabletop port layer 42 includes a plurality of fastener sockets 54 into which a fastener (e.g., an end of a fastener, such as a screw, bolt, or other fastener) may be inserted and tightened, e.g., via a service hole 32 in each of the other layers. Alternatively, or in addition, a fastener bore in tabletop port layer 42 may entirely traverse the thickness of tabletop port layer 42. Airflow through tabletop ports 44 may create an air cushion for noncontact support of a thin workpiece.

Figure 6A:
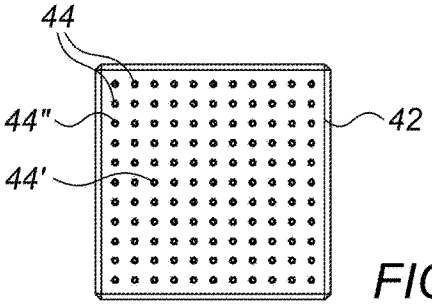
FIG. 6A is a schematic top view of the tabletop port layer of the noncontact support platform table shown in FIG. 5B.

FIG. 6A is a schematic top view of the tabletop port layer of the noncontact support platform table shown in FIG. 5B.

As shown, tabletop ports 44 are distributed in a regular pattern (e.g., a square grid pattern as in the example shown) over the top of tabletop port layer 42.

In the example shown in FIGS. 5A and 5B, each tabletop port 44 is connected to its pressure or suction source via flow restrictors in flow restrictor layer 48. Flow restrictor layer 48 may constrict airflow through each port channel 46, e.g., to create a fluidic spring effect. As seen in the example of FIG. 5B, flow restrictor layer 48 may be assembled from component orifice layers 48*a*, 48*b*, and 48*c*.

Figure 6B:
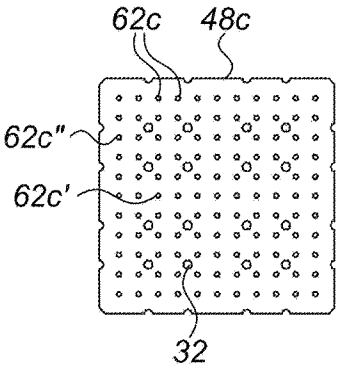
FIG. 6B schematically illustrates component orifice layers of the noncontact support platform table shown in FIG. 5B.
Figure 6B:
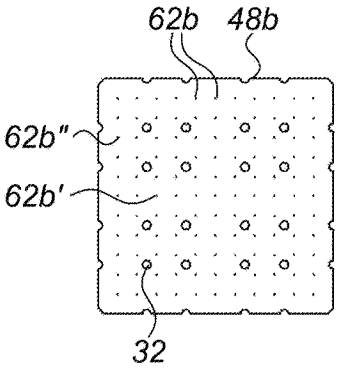
Figure 6B:
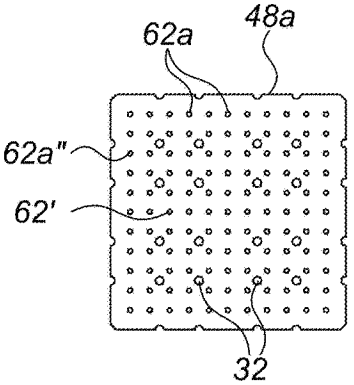

FIG. 6B schematically illustrates component orifice layers of a flow restrictor layer of the noncontact support platform table shown in FIG. 5B.

Component orifices 62*a*, 62*b*, and 62*c* in component orifice layers 48*a*, 48*b*, and 48*c*, respectively, may be aligned with one another to form a single orifice. In the example shown, the diameter of component orifice 62*b* may be narrower than the diameters of component orifices 62*a* and 62*c*. Thus, restriction of airflow may take place at component orifice 62*b*, while component orifices 62*a* and 62*c* function as entrance and exit openings to the restrictive orifice. In other cases, flow restrictor layer 48 may include only component orifice layer 48*b*, or component orifice layer 48*b* together with component orifice layer 48*a* or component orifice layer 48.

Noncontact support platform table 40 includes vacuum conduit layer 20 which is connectable to a suction source 26 via suction manifold 56 and suction connector 58. Noncontact support platform table 40 also includes a pressure conduit layer 10 that is connectable to a pressure source 16 via pressure manifold 52 and pressure connector 50.

Figure 6D:
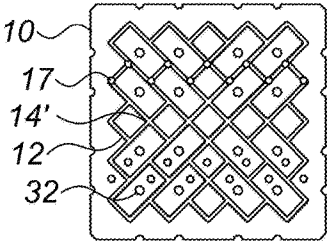
FIG. 6D schematically illustrates a vacuum conduit layer of the noncontact support platform table shown in FIG. 5B.
Figure 6C:
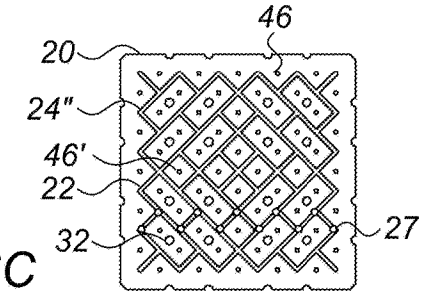
FIG. 6C schematically illustrates a vacuum conduit layer of the noncontact support platform table shown in FIG. 5B.

FIG. 6C schematically illustrates a vacuum conduit layer of the noncontact support platform table shown in FIG. 5B. FIG. 6D schematically illustrates a vacuum conduit layer of the noncontact support platform table shown in FIG. 5B.

In the example shown, vacuum conduit layer 20 and pressure conduit layer 10 are arranged in the configuration shown in 4B, with vacuum conduits 22 and pressure conduits 12 removed to make a space for service holes 32. Service holes 32 do not coincide with any conduits, ports, or openings in any of the layers. In some cases, one or more service holes 32 may be utilized for attaching or leveling noncontact support platform table 40 on supporting structure, or for insertion of a sensor (e.g., for inspection or for monitoring a manufacturing process).

When noncontact support platform table 40 is assembled, pressure connections 17 open to pressure manifold 52. Pressure may be applied to one more pressure ports 14 at intersections between pressure conduits 12 via pressure conduits 12. Openings in layers that intervening between pressure conduit layer 10 and tabletop port layer 42 may enable airflow between pressure port 14 and the aligned tabletop port 44.

For example, pressure port location 14' may be aligned with port channel 46' on vacuum conduit layer 20, with component orifices 62*a*', 62*b*', and 62*c*' in component orifice layers 48*a*, 48*b*, and 48*c*, respectively, and with tabletop pressure port 44' in tabletop port layer 42. Thus, air may flow outward from tabletop pressure port 44'.

Similarly, when noncontact support platform table 40 is assembled, vacuum connections 27 open to suction manifold 56. Suction may be applied to one more vacuum ports 24 at intersections between vacuum conduits 22 via vacuum conduits 22. Openings in layers that intervening between vacuum conduit layer 20 and tabletop port layer 42 may enable airflow between vacuum port 24 and the aligned tabletop port 44.

For example, vacuum port location 24" may be aligned with component orifices 62*a*", 62*b*", and 62*c*" in component orifice layers 48*a*, 48*b*, and 48*c*, respectively, and with tabletop vacuum port 44" in tabletop port layer 42. Thus, air may be sucked into tabletop vacuum port 44".

Figure 7:
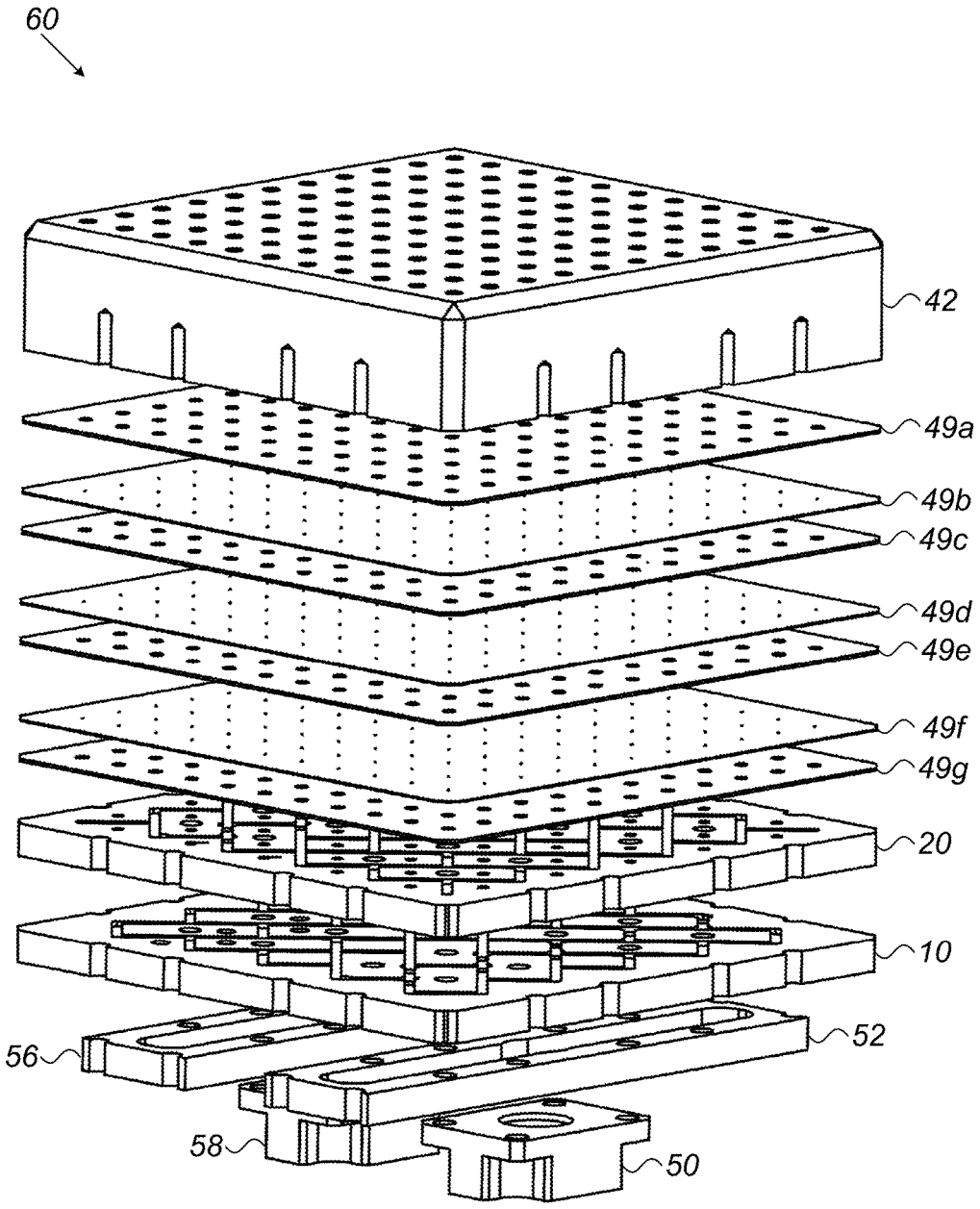
FIG. 7 schematically illustrates a variant of the noncontact support platform table shown in FIG. 5B having multiple orifice layers.

FIG. 7 schematically illustrates a variant of the noncontact support platform table shown in FIG. 5B having multiple flow restrictor layers.

In the example shown of noncontact support platform table 60, flow restrictors of component orifice layers 49*a*, 49*c*, 49*e*, and 49*g* may function as entrance and exit openings to restrictive orifices in component orifice layers 49*b*, 49*d*, and 49*f*. In some cases, some of the orifices of component orifice layers 49*b*, 49*d*, and 49*f* may be narrow and restrictive, while others may be wide and function as non-restrictive channels for the airflow. For example, component orifice layer 49*b* may be configured to restrict vacuum flow only, while component orifice layers 49*d* and 49*f* may be configured to restrict pressure flow only.

Figure 8:
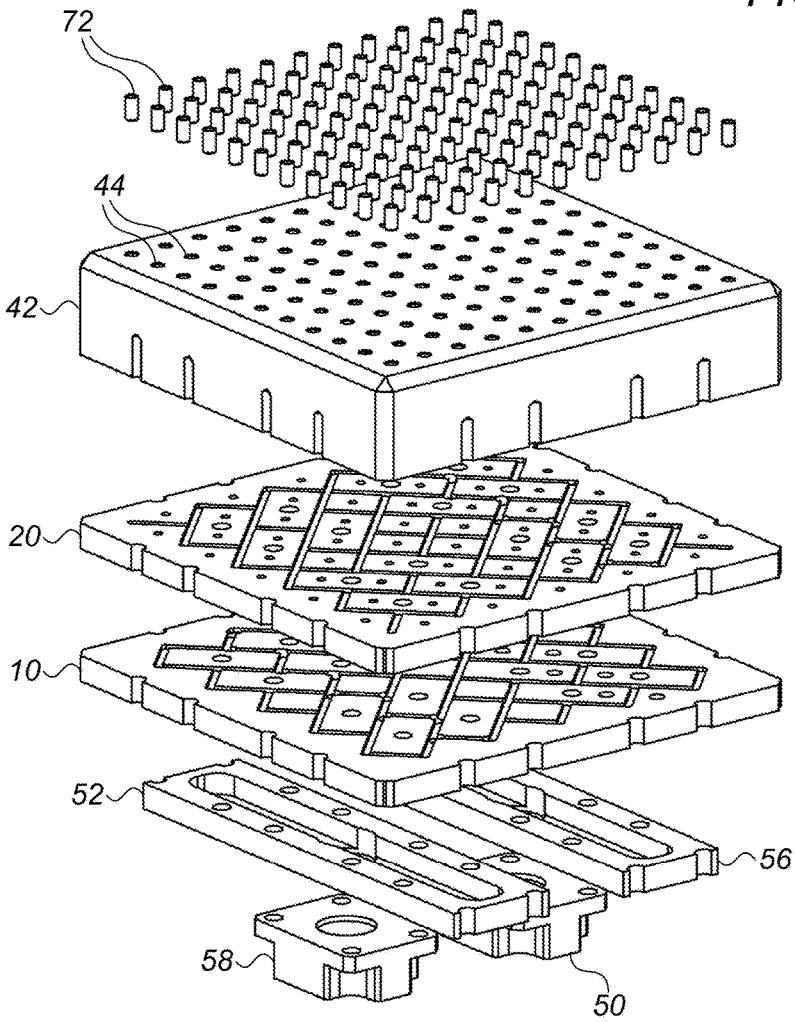
FIG. 8 schematically illustrates a variant of the noncontact support platform table shown in FIG. 5B, with flow restrictors incorporated into inserts.

FIG. 8 schematically illustrates a variant of the noncontact support platform table shown in FIG. 5B, with flow restrictors incorporated into inserts.

In the example shown of noncontact support platform table 70, a plurality of flow restrictor inserts 72 may be inserted into tabletop ports 44. Each flow restrictor insert 72 may include a restrictor in the form of a constriction or other structure that functions as a restrictive orifice for airflow through the tabletop port 44 into which flow restrictor insert 72 is inserted.

A flow restrictor insert 72 may have different configurations.

Figure 9A:
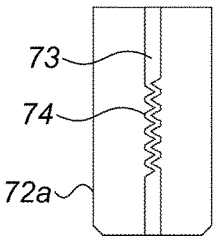
FIG. 9A schematically illustrates a flow restrictor insert that incorporates a self-adaptive segmented orifice (SASO) flow restrictor.

FIG. 9A schematically illustrates a flow restrictor insert that incorporates a self-adaptive segmented orifice (SASO) flow restrictor.

An orifice bore 73 of SASO flow restrictor insert 72*a* includes SASO flow restrictor 74.

Figure 9B:
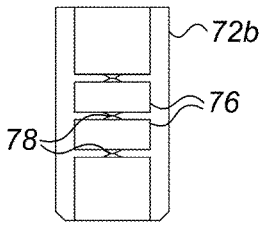
FIG. 9B schematically illustrates a flow restrictor insert that incorporates a segmented orifice flow restrictor.

FIG. 9B schematically illustrates a flow restrictor insert that incorporates a segmented flow restrictor.

Segmented flow restrictor insert 72*b* includes a linear arrangement of a plurality of bore segments 76 separated by narrower restrictive segments 78.

Figure 9C:
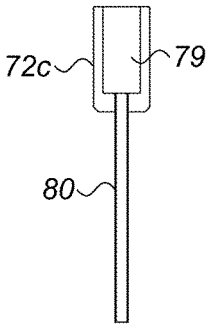
FIG. 9C schematically illustrates a flow restrictor insert that incorporates a tubular flow restrictor.

FIG. 9C schematically illustrates a flow restrictor insert that incorporates a tubular flow restrictor.

Bore 79 of tubular flow restrictor insert 72*c* extends into restrictive tube 80 with a diameter that is smaller than the diameter of bore 79. Resistance to flow may be determined by the inner diameter and length of restrictive tube 80. Restrictive tube 80 may have a constant diameter along its length, or may include one or more constricted segments that may further increase resistance to flow.

Figure 9D:
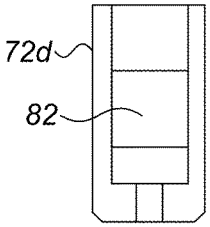
FIG. 9D schematically illustrates a flow restrictor insert that incorporates a porous flow restrictor.

FIG. 9D schematically illustrates a flow restrictor insert that incorporates a porous flow restrictor.

Porous flow restrictor insert 72*d* is filled with a porous core 82 that restricts airflow through porous core 82. The resistance to flow through porous core 82 may be determined by the diameter and length of porous core 82, as well as by the density of porous material that fills porous core 82.

Other configurations of flow restrictors and orifice inserts may be provided.

In the examples shown, e.g., as in FIG. 1A, corners at intersections between conduits are shown to be sharp. In other cases, corners may be rounded.

Figure 10:
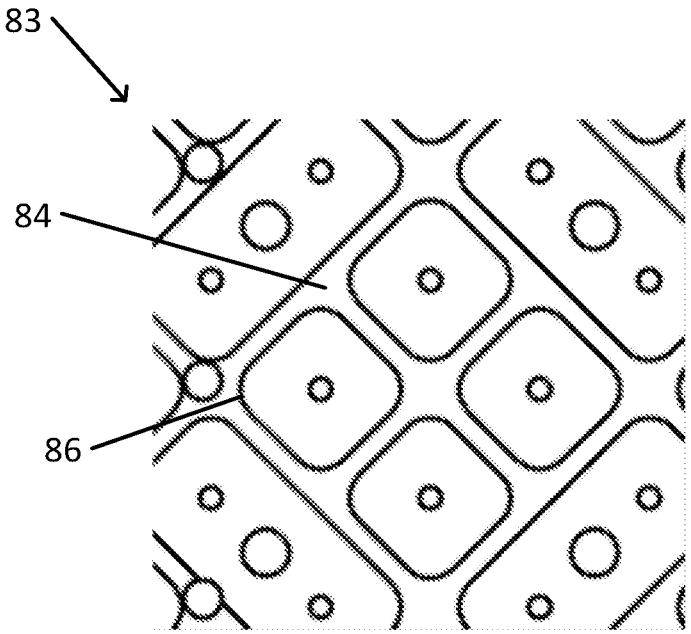
FIG. 10 schematically illustrates part of a conduit layer with rounded corners.

FIG. 10 schematically illustrates part of a conduit layer with rounded corners.

Conduit layer 83 may represent, for example, part of a pressure conduit layer 10 or a vacuum conduit layer 20. Conduits 84 may represent pressure conduits 12 or vacuum conduits 22. In the example shown, conduits corners 86 at intersections between conduits 84 (e.g., orthogonal conduits as in the example shown) are rounded. A rounded conduit corner 86 may, in some cases, reduce resistance to airflow and thus reduce pressure drops within conduit layer 83.

A method for assembling a noncontact support platform table 40 (e.g., with reference FIG. 5B) may include providing a tabletop port layer 42, a pressure conduit layer 10, and a vacuum conduit layer 20, as described above. The following describes assembly of a noncontact support platform table 40 in which vacuum conduit layer 20 is assembled between pressure conduit layer 10 and tabletop port layer 42. In other cases, a pressure conduit layer may be assembled between a vacuum conduit layer and tabletop port layer 42, with appropriate modifications as would be understood by one skilled in the art.

Vacuum conduit layer 20 may be assembled at a lateral position relative to tabletop port layer 42 such that every tabletop port 44 that is to function as a vacuum port 24 coincides with an intersection between at least two vacuum conduits 22.

Similarly, pressure conduit layer 10 may be assembled to tabletop port layer 42 and vacuum conduit layer 20 at a lateral position such that every tabletop port 44 that is to function as a pressure port 14 coincides with an intersection between at least two pressure conduits 12 and with a port channel 46 of vacuum conduit layer 20.

In some cases, a flow restrictor layer 48 (e.g., comprising one or more component layers) may be assembled between one or both of pressure conduit layer 10 and vacuum conduit layer 20, and tabletop port layer 42. In some cases, flow restrictor inserts 72 may be inserted into some or all of tabletop ports 44.

One or more of a pressure manifold 52 or a suction manifold 56 may be assembled so as to open to pressure conduit layer 10 or vacuum conduit layer 20, respectively.

When the layers are being assembled, all of the layers may be laterally positioned relative to one another such that service holes 32 on the various layers align with one another to form a contiguous opening through the layers. Each service hole 32 may be aligned with a fastener socket 54 or a corresponding hole or opening on tabletop port layer 42. For example, fastening structure may be inserted through the aligned service holes 32 and the fastener socket 54 or other hole or opening in tabletop port layer 42 so as to tightly hold the layers to one another. In some cases, one or more service holes 32 may be aligned with a similar hole, bore, or opening on tabletop port layer 42, e.g., to enable insertion of a sensor or tool.

Different embodiments are disclosed herein. Features of certain embodiments may be combined with features of other embodiments; thus, certain embodiments may be combinations of features of multiple embodiments. The foregoing description of the embodiments of the invention has been presented for the purposes of illustration and description. It is not intended to be exhaustive or to limit the invention to the precise form disclosed. It should be appreciated by persons skilled in the art that many modifications, variations, substitutions, changes, and equivalents are possible in light of the above teaching. It is, therefore, to be understood that the appended claims are intended to cover all such modifications and changes as fall within the true spirit of the invention.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

The invention claimed is:

1. A noncontact support system having a table comprising:

a port layer that includes a pattern of interspersed pressure ports and vacuum ports;

a pressure conduit layer that includes a grid pattern of pressure conduits, connectable to a pressure source, each of the pressure ports being located at a location on an axis passing through an intersection of at least two of the pressure conduits and substantially orthogonal to the grid pattern of pressure conduits at that location; and a vacuum conduit layer that includes a grid pattern of vacuum conduits, connectable to a suction source, each of the vacuum ports being located at a location on an axis passing through an intersection of at least two of the vacuum conduits and substantially orthogonal to the grid pattern of vacuum conduits at that location, the grid pattern of vacuum conduits being laterally offset from the grid pattern of pressure conduits such that each intersection of pressure conduits is laterally offset from all intersections of the vacuum conduits.

2. The noncontact support system of claim 1, wherein the pressure conduit layer and the vacuum conduit layer each includes a service hole that is configured to enable insertion of a fastener or sensor when a service hole of the pressure conduit layer is aligned with the service hole of the vacuum conduit layer, each of the service holes being laterally displaced from all of the pressure and vacuum conduits.

3. The noncontact support system of claim 2, wherein the service hole is located such that a lateral distance between the service hole and the nearest conduit is greater than a minimum distance.

4. The noncontact support system of claim 2, wherein the grid pattern is a square pattern, and wherein the service hole is located laterally midway between a pressure port and the nearest vacuum port.

5. The noncontact support system of claim 2, wherein the grid pattern of each of the pressure conduit layer and the vacuum conduit layer is a square pattern with a segment of a pressure conduit and an orthogonal vacuum conduit removed in a square region bounded by two of the intersections between pressure conduits and two of the intersections between vacuum conduits.

6. The noncontact support system of claim 5, wherein the service hole is located in the square region.

7. The noncontact support system of claim 1, wherein the pressure conduit layer comprises an opening to a pressure manifold or the vacuum conduit layer comprises an opening to a vacuum manifold.

8. The noncontact support system of claim 1, further comprising at least one flow restrictor layer that includes a flow restrictor to restrict airflow between the pressure conduit layer and a pressure port of the port layer.

9. The noncontact support system of claim 8, further comprising at least one flow restrictor layer that includes a flow restrictor to restrict airflow between the vacuum conduit layer and a vacuum port on the port layer.

10. The noncontact support system of claim 1, further comprising an insert for insertion of a port of the port layer, the insert including a flow restrictor.

11. The noncontact support system of claim 10, wherein the flow restrictor comprises a self-adaptive segmented orifice (SASO) flow restrictor.

12. The noncontact support system of claim 10, wherein the flow restrictor comprises a linear arrangement of a plurality of bore segments separated by narrower restrictive segments.

13. The noncontact support system of claim 10, wherein the flow restrictor comprises a restrictive tube having a constant diameter along its length.

14. The noncontact support system of claim 10, wherein the flow restrictor comprises a restrictive tube that includes one or more constricted segments.

15. The noncontact support system of claim 10, wherein the flow restrictor comprises a porous substance.

16. The noncontact support system of claim 1, wherein a corner at an intersection between conduits in the pressure conduit layer or the vacuum conduit layer is rounded.

17. A method for assembling a noncontact support system, the method comprising:

assembling to a port layer that includes a pattern of interspersed pressure ports and vacuum ports a pressure conduit layer that includes a grid pattern of pressure conduits that are connectable to a pressure source, such that each of the pressure ports opens to an intersection of at least two of the pressure conduits; and assembling to the port layer and to the pressure conduit layer a vacuum conduit layer that includes a grid pattern of vacuum conduits that are connectable to a suction source such that each of the vacuum ports opens to an intersection of at least two of the vacuum conduits, the grid pattern of vacuum conduits being laterally offset from the grid pattern of pressure conduits such that each intersection of pressure conduits is laterally offset from all intersections of the vacuum conduits.

18. The method of claim 17, wherein assembling the vacuum conduit layer to the pressure conduit layer comprises aligning a service hole on the pressure layer with a service hole on the vacuum conduit layer, the service hole being laterally displaced from all of the pressure ports and all of the vacuum ports.

19. The method of claim 18, further comprising inserting a fastening structure through the service holes and into a hole or socket of the port layer that is aligned with the services holes on the pressure conduit layer and the vacuum conduit layer.

20. The method of claim 17, further comprising insertion of a flow restrictor layer between at least the pressure conduit layer and the port layer.

* * * * *